US008742875B2

(12) United States Patent
Eriksson et al.

(10) Patent No.: US 8,742,875 B2
(45) Date of Patent: Jun. 3, 2014

(54) CONTACTOR

(75) Inventors: Anders Eriksson, Västerås (SE); David Karlén, Västerås (SE); Lars Eriksson, Västerås (SE); Ove Coman, Västerås (SE)

(73) Assignee: ABB AB (SE)

( * ) Notice: Subject to any disclaimer, the term of this patent is extended or adjusted under 35 U.S.C. 154(b) by 0 days.

(21) Appl. No.: 13/491,103

(22) Filed: Jun. 7, 2012

(65) Prior Publication Data

US 2012/0242433 A1 Sep. 27, 2012

Related U.S. Application Data

(63) Continuation of application No. PCT/EP2009/066617, filed on Dec. 8, 2009.

(51) Int. Cl.
*H01H 9/00* (2006.01)

(52) U.S. Cl.
USPC ..... 335/202; 335/185

(58) Field of Classification Search
USPC ..... 335/202
See application file for complete search history.

(56) References Cited

U.S. PATENT DOCUMENTS

| | | | | |
|---|---|---|---|---|
| 4,973,929 | A * | 11/1990 | Duchemin | 335/132 |
| 5,535,083 | A * | 7/1996 | Sako et al. | 361/38 |
| 5,576,676 | A * | 11/1996 | Koller et al. | 335/132 |
| 5,684,442 | A * | 11/1997 | Hufschmid | 335/132 |
| 7,474,182 | B2 * | 1/2009 | Bolz et al. | 335/131 |
| 8,314,670 | B2 * | 11/2012 | Johansson et al. | 335/202 |
| 8,334,741 | B2 * | 12/2012 | Eriksson et al. | 335/202 |
| 2006/0152312 | A1 * | 7/2006 | Stanke et al. | 335/202 |
| 2012/0126916 | A1 * | 5/2012 | Eriksson et al. | 335/2 |

FOREIGN PATENT DOCUMENTS

| | | | |
|---|---|---|---|
| CN | 101017748 | A | 8/2007 |
| DE | 29610329 | U1 | 8/1996 |
| DE | 102004009650 | B3 | 7/2005 |
| EP | 1918958 | A1 | 5/2008 |
| WO | 2008080301 | A1 | 7/2008 |

OTHER PUBLICATIONS

International Preliminary Report on Patentability; Application No. PCT/EP2009/066617; Issued Apr. 19, 2012, 21 pages.
International Search Report and Written Opinion of the International Searching Authority; Application No. PCT/EP2009/066617; Issued: Jul. 27, 2010; Mailing Date: Aug. 4, 2010; 9 pages.

* cited by examiner

*Primary Examiner* — Shawki S Ismail
*Assistant Examiner* — Lisa Homza
(74) *Attorney, Agent, or Firm* — St. Onge, Steward Johnston & Reens LLC

(57) ABSTRACT

A contactor has a frame including a base unit, a coil provided on the base unit and including input terminals, and a module including a circuit board for electrically controlling the coil, the circuit board including input terminals for power supply and output terminals for providing an electrical connection to the coil. The contactor further includes a fastening device arranged for mechanically and electrically connecting one of the output terminals to a corresponding input terminal of the coil, and the module is designed such that the fastening device connects the output terminal of the circuit board to the input terminal of the coil while at the same time the module is connected to the frame.

11 Claims, 8 Drawing Sheets

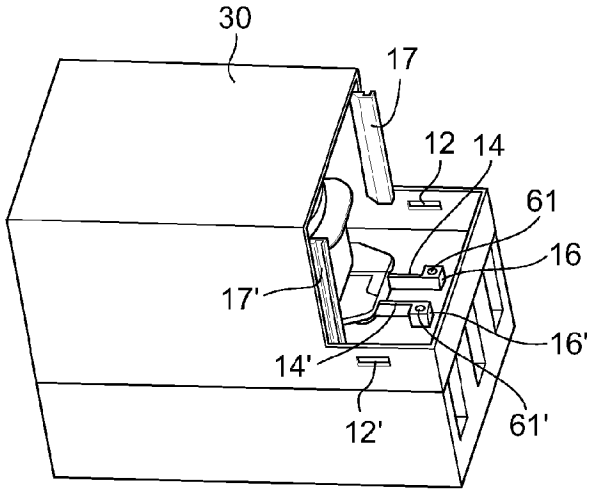
Fig. 2a
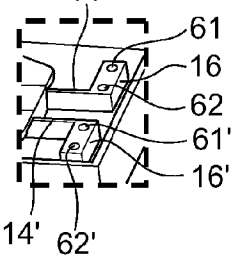
Fig. 2b
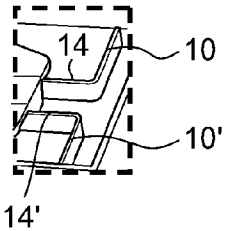
Fig. 2c
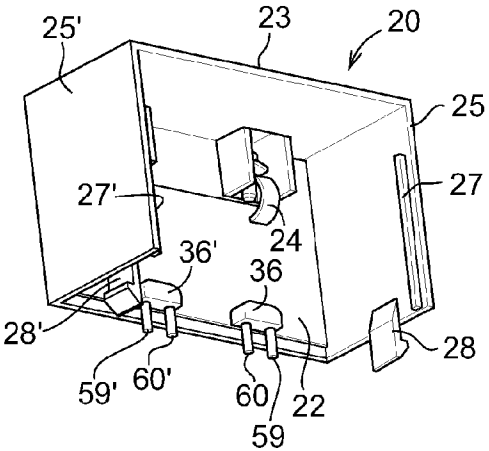
Fig. 3a
Fig. 3b
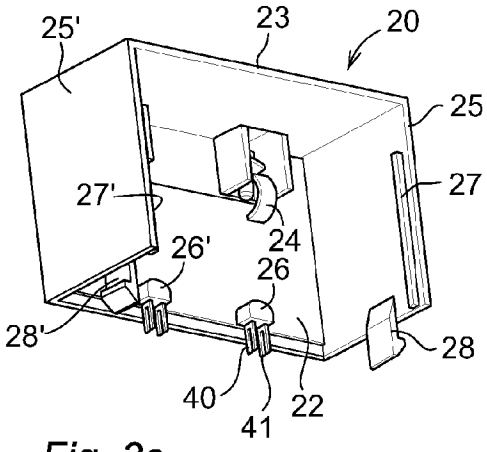
Fig. 3c

CONTACTOR

CROSS-REFERENCE TO RELATED APPLICATIONS

The present application is a continuation of pending International patent application PCT/EP2009/066617 filed on Dec. 8, 2009 which designates the United States and the content of which is incorporated herein by reference.

FIELD OF THE INVENTION

The present invention relates to contactor used, for example, for switching an electric power or control circuit of an electrical device such as an electric motor, a lighting unit, a heating apparatus or a capacitor bank.

BACKGROUND OF THE INVENTION

A contactor is an electrically controlled switch device used for switching an electric power or control circuit of an electrical load device. Such a contactor comprises a base and, thereon, an electromagnet apparatus and a contact system. The electromagnet apparatus is used to operate (open or close) a contact system of a contactor, wherein the contact system comprises a movable contact and a stationary contact. Such an electromagnet apparatus includes a fixed part with a magnet core and a coil, and a movable magnet part being connected to the movable contact and movable between a rest position and a working position. To control the contactor, an electrical circuit board is electrically connected to the coil for energizing or de-energizing the electromagnet apparatus. Such an electrical circuit board comprises input terminals for power supply and output terminals for providing electricity to the coil. This means that the output terminals have to be connected to input terminals of the coil by some kind of connecting means.

The working environment of such a contactor is usually bumpy. Cables are used to connect the coil and the electrical circuit board since the cables, by their property, are flexible and therefore are able to take care of all bumpy movements without affecting mechanical and electrical connection between the coil and the electric circuit board. This however needs a demanding mounting process, meaning that the mounting has to be carried out in two stages, first mounting one end of the cable to an output terminal of the electric circuit board and then mounting another end of the cable to an input terminal of the coil. Such a mounting process is costly in view of the cost of an electrical circuit board. Cable connections also make it difficult to replace a circuit board because the replacement involves a dismantling process of a cable and a mounting process of the cable.

A Chinese patent application with the publication number CN101017748 discloses a contactor comprising a winding arranged in a foundation seat unit, a cavity being provided for receiving a controlling circuit board, and the output terminals of the controlling circuit board being connected to the windings by means of connection cables.

SUMMARY OF THE INVENTION

The object of the present invention is to provide a contactor which requires a reduced manufacturing time and therefore reduces the cost of manufacturing contactors.

This object is achieved by a contactor according to the present teachings.

Such a contactor may comprise a frame including a base unit, a coil provided on the base unit and including input terminals, and a module comprising a circuit board for electrically controlling the coil, the circuit board including input terminals for power supply and output terminals for providing an electrical connection to the coil. The contactor further comprises a fastening device arranged for mechanically and electrically connecting one of the output terminals to a corresponding input terminal of the coil, and the module is designed such that the fastening device connects the output terminal of the circuit board to the input terminal of the coil simultaneously as the module is connected to the frame.

Due to the fact that a fastening device is provided for mechanically and electrically connecting the output terminal to a corresponding input terminal of the coil, the invention enables the output terminals of the circuit board to be connected to the input terminals of the coil at the same time as the module is connected to the frame of the contactor. Therefore, cable connections may no longer be needed and the number of mounting steps for connecting and mounting the circuit board into the contactor may be reduced into one single step, and the manufacturing time and cost are reduced.

The circuit board arranged on the module may be any of a single electrical circuit board or a printed circuit board.

According to an embodiment of the invention, the fastening device further includes a male and a female connector. The male connector may be arranged on at least one of the output terminals of the circuit board, and the female connector may be accordingly arranged on one of the input terminals of the coil. Alternatively, the male connector may be arranged on one of the input terminals of the coil. In this case, the female connector will be arranged on one of the output terminals of the circuit board. The female connector is designed to get hold of the male connector for retaining a contact force between the input terminal of the coil and output terminal of the circuit board when the module is connected to the frame. The female connector may be, for example, a socket, a slot or in other forms, while the male connector may be, for example, a plug, a pin or in other forms. It shall be understood that both male and female connectors are made of conductive materials for electrical connection.

According to another preferred embodiment of the invention, the fastening device comprises a clamping device and a connection bar. The clamping device is designed to clamp the connection bar for providing and retaining a contact force between the input terminal of the coil and output terminal of the circuit board. The clamping device may be provided either on the output terminals of the circuit board or on the input terminals of the coil and, accordingly, the connection bar is provided on the input terminals of the coil or on the output terminals of the circuit board.

It is an advantage that the clamping device is provided either on the output terminals of the circuit board or on the input terminals of the coil because this makes it possible to electrically connect the circuit board to the coil and, at the same time, provide a stable mechanical connection between the circuit board and the coil so that the electrical connection between the circuit board and the coil will not be lost in a bumpy working environment.

According to an embodiment of the invention, the clamping device includes at least one pair of deformable elements arranged to clamp the connection bar at a first position.

According to another preferred embodiment of the invention, another pair, a second pair of deformable elements is arranged on the clamping device to clamp the connection bar at a second position at a distance from the first position, so that a stable mechanical and electrical connection are established.

In accordance with an embodiment of the invention, the module is arranged detachable from the frame. It is advantageous that the module is designed to be detectable from the frame to provide an easy replacement of a defective module. It may be also a case where an old module will be replaced by a new module containing a different function or more functions than the old one.

According to an embodiment of the invention, the module further comprises a fastening member for mechanically connecting the module to the frame. With the facilitating of the fastening member, a stable connection between the module and frame is secured.

According to an embodiment of the invention, the frame includes a casing for connection to the base unit and providing a shield for the coil, the module including at least a part of the casing, and said part of the casing being arranged partly surrounding the circuit board. It is advantageous that the module is designed as a part of the casing to enable an easier replacement of the module by just removing the old module and installing a new one without removing other elements of the contactor.

According to a preferred embodiment of the invention, the frame includes a casing for connection to the base unit and providing a shield for the coil, the casing including a first casing part and a second casing part, the module including the second casing part, the second casing part being arranged partly surrounding the circuit board, and the first and second casing parts being arranged to be connected to each other upon the connection of the module to the frame such that the casing encloses the circuit board together with the base unit, which ensures that the circuit board is safely secured inside of the contactor that is exposed in a dusty and humid working environment. The first and second casing parts may further comprise a respective guiding member for guiding the module such that the fastening device is connected to the input terminal of the coil upon the connection of the module to the frame. The second casing part may be realized in different shapes and forms, for example, a cassette or an L-formed part with the circuit board embedded inside.

A method for assembling the contactor may comprise steps of installing the coil on the base unit, mounting the module to the frame, which includes connecting the module to the frame simultaneously as the fastening device connects the output terminals of the circuit board to the corresponding input terminals of the coil.

In the event that the casing comprises two parts, a first and second part, the method may further comprise a step of connecting the first casing part to the second casing part, which may be achieved by the guiding members arranged on the parts upon mounting the module to the frame such that the circuit board is enclosed by the casing together with the base unit and the assembling is completed.

Such a contactor may be arranged to operate for example within a low voltage area, wherein a low voltage is commonly defined as up to about 1000 V ac or 1500 V dc.

BRIEF DESCRIPTION OF THE DRAWINGS

The invention will now be explained more closely by the description of different embodiments of the invention and with reference to the appended figures.

FIG. 2A illustrates a perspective view of the contactor shown in the FIG. 1 with the casing, with a first part of the casing mounted, according to a second embodiment of the invention, wherein a female connector is provided on an input terminal of the coil;

FIG. 2B illustrates a perspective view of another female connector of a fastening device, according to a third embodiment of the invention;

FIG. 2C illustrates a perspective view of a connection bar of a fastening device, according to a fourth embodiment of the invention;

FIG. 3A shows a perspective view of a module comprising an electric circuit board and a male connector corresponding to the male connector illustrated in FIG. 2*a*, according to the second embodiment of the invention;

FIG. 3B shows a perspective view of a module comprising an electric circuit board and a male connector corresponding to the male connector illustrated in FIG. 2*b*, according to the third embodiment of the invention;

FIG. 3C shows a perspective view of a module comprising an electric circuit board and a clamping device corresponding to the connection bar illustrated in FIG. 2*c*, according to the fourth embodiment of the invention;

DETAILED DESCRIPTION OF THE INVENTION

Figure 1:
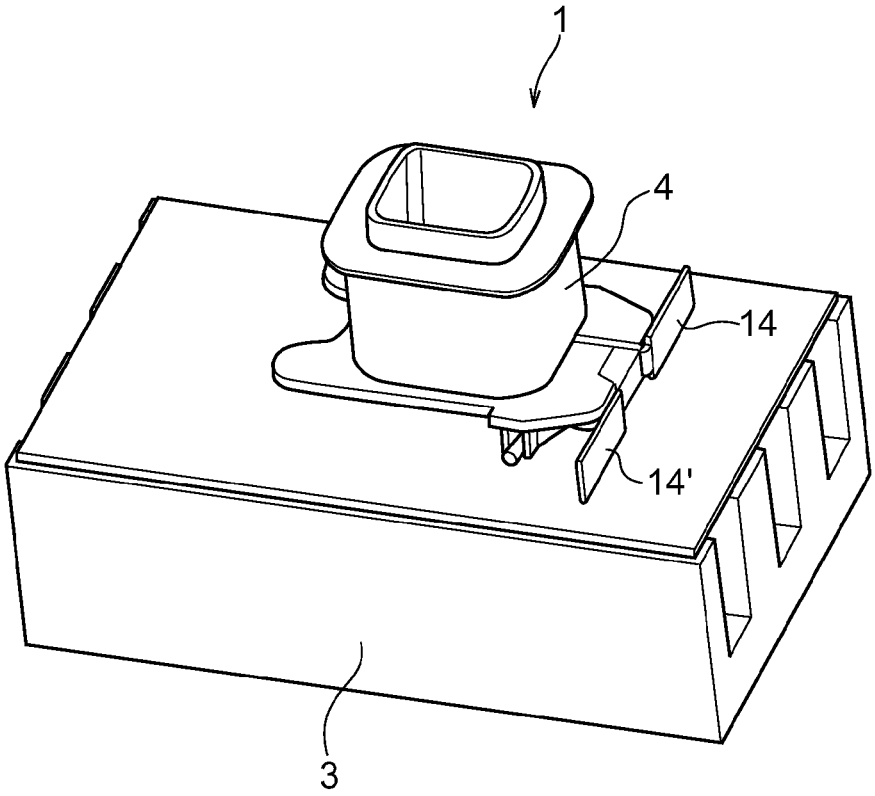
FIG. 1 shows a perspective view of a contactor without a casing, according to a first embodiment of the invention.
Figure 5A:
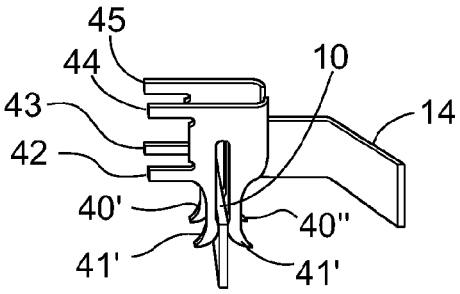
FIG. 5A-5C show detailed perspective views of a clamping device being connected to the input terminals of a coil and sited on the module, in accordance with to a fifth embodiment of the invention.
Figure 5B:
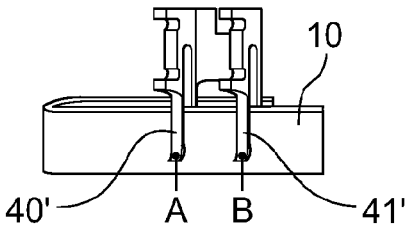
Figure 5C:
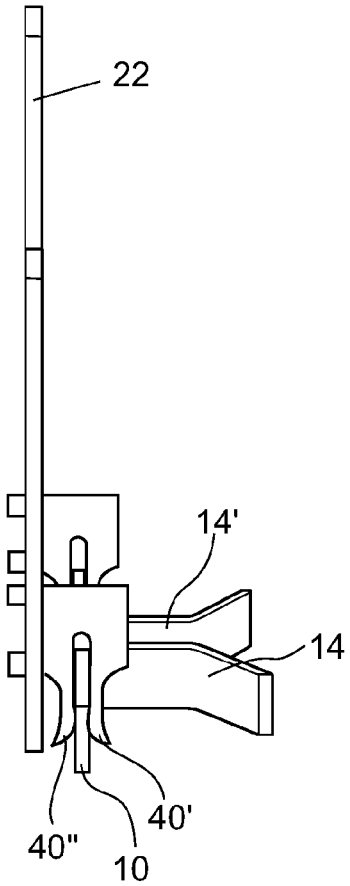

FIG. 1 shows a perspective view of a contactor without a casing, according to an embodiment of the invention. The contactor 1 comprises a frame including a base unit 3 and a coil 4. The coil 4 is sited on the base unit 3 and wound around a magnet core, not seen in the figure. The coil 4 includes input terminals 14, 14' for receiving electrical power to energize the magnet core in order to make a contact. An example of a possible construction of the input terminals of the coil is illustrated in FIGS. 5*a-c* in details.

The contactor with a first casing part of a casing mounted on the base unit is illustrated in FIG. 2*a*. The casing is arranged to provide a shield for the coil and other parts of the contactor. FIG. 3*a* shows a perspective view of a module comprising an electric circuit board 22, and the module detachable from the frame is to be mounted to the frame.

The casing and the base unit 3 defines the frame. In this embodiment, the casing is connected to the base and comprises a first casing part 30 for providing a partial shield for the coil and a second, separate casing part in the form of a cassette. The module comprises the second casing part 20, a fastening member for mechanically connecting the module to the frame and the electric circuit board 22 for electrically controlling the coil. The second casing part 20 includes two opposite sidewalls 25, 25', a rear wall 29 and a top wall 23. The electric circuit board 22 is mounted on the inner side of the rear wall 29 of the second casing part 20. The walls of the second casing part build another partial shield for the coil and the electric circuit board when the second casing part 20 is connected to the first casing part 30.

The electric circuit board 22 includes input terminals 24 and 24' for connecting a power supply to the electric circuit board and output terminals for providing an electrical connection to the coil.

In this embodiment, the fastening member is arranged on the sidewalls 25, 25' of the second casing part. The fastening member further includes two connectors 28 and 28' protruding outwardly from end of the sidewall 25, 25' and being arranged to be connected to the frame when the second casing part is connected to the first casing so as to enclose the coil and the circuit board inside of the contactor. To be incorporated with each 28, 28' of the connectors upon the connection, an opening 12, 12' is provided on the casing and is arranged to be hooked with the corresponding connector. The connectors 28 and 28' are made of flexible material, for example thermoplastics, that will be deflected briefly during joining operation and catches in a depression in the openings 12 and 12'. In this example, the connector 28, 28' is in the form of a hook, the opening 12, 12' is in the form of rectangle. It is understood that the connectors and openings form snap-fit joints and therefore other kinds of snap-fit joints are also applicable. For example, the connectors may also be a stud or bead.

Each of the output terminals of the circuit board may include a male connector 36, 36' and each of the input terminals 14, 14' of the coil may include a female connector 16, 16', both arranged for mechanically and electrically connecting the output terminal to a corresponding input terminal of the coil.

In this example, the male connector 36, 36' is in the form a plug/pin 60, 60' and the female connector 16, 16' is in the form a socket/slot 61, 61' adapted to be cooperated with the plug/pin upon the connection.

It shall be understood that female and male connectors may be in other forms as well. For example, FIGS. 2*b* and 3*b* show another embodiment, wherein a male connector 36, 36' comprises two plugs/pins 59, 60, 59', 60' arranged on each of the output terminals of the circuit board, and two sockets 61, 62, 61', 62' are arranged on a female connector 16, 16' provided on each of the input terminals of the coil.

It shall also be understood that, although the male connectors illustrated in FIGS. 3*a* and 3*b* are arranged on the output terminals of the circuit board, a male connector may be arranged on an input terminal of the coil as well, in this case, a female connector may be arranged on a corresponding output terminal of the circuit board.

Figure 4:
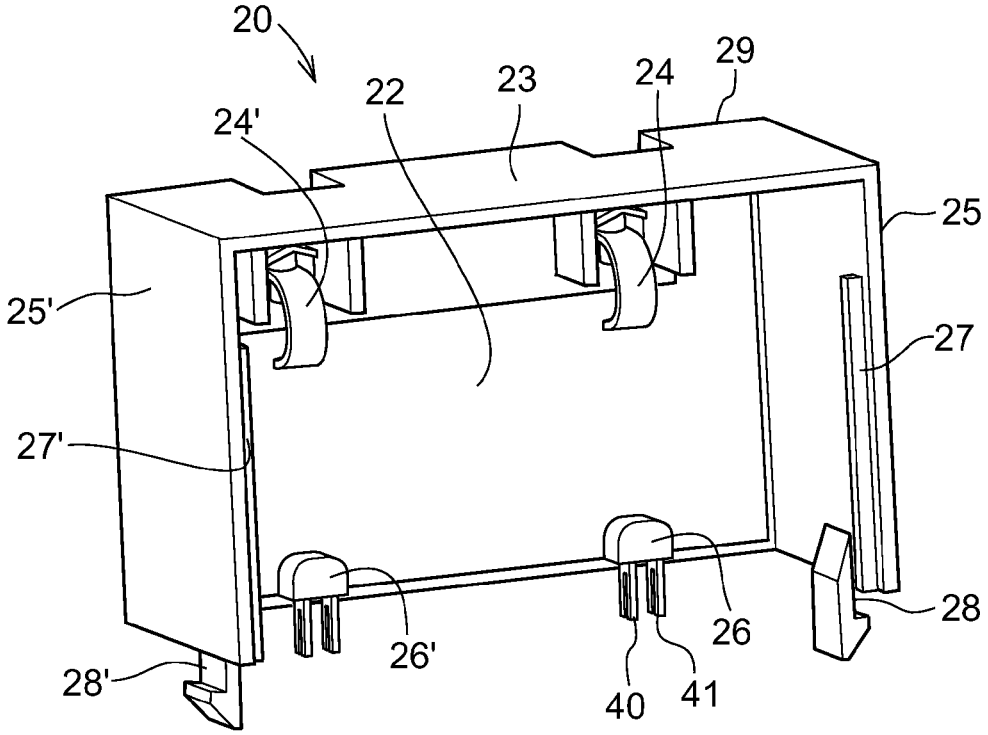
FIG. 4 is a front view of the module illustrated in FIG. 3*c;*

In another preferred embodiment as shown in FIGS. 2*c* and 3*c*, the fastening device comprises a clamping device and a connection bar. In this example, the clamping device 26, 26' is arranged on each of the output terminals of the circuit board and the connection bar 10, 10' is provided on each of the input terminals of the coil and has the form of an elongated bar, which are together for mechanically and electrically connecting the output terminal to a corresponding input terminal of the coil. However, another arrangement is also applicable, for example an arrangement of clamping devices provided on input terminals and connection bars on output terminals. A detailed front view of the module is illustrated in FIG. 4.

FIG. 5*a-c* show in details how a clamping device clamps tightly on a connection bar. The clamping device includes two pairs 40, 41 of deformable elements. Each pair 40, 41 of the deformable elements further including two legs 40' and 40", 41' and 41". In this embodiment, the legs are constructed with feet bent outwardly to facilitate the mounting even more. The clamping device further includes four pins 42-45 arranged on one side of the clamping device and for connecting to the circuit board, which may however be realized by other means. The first pair of the legs 40' and 40" are arranged to clamp the connection bar 10 at a first position A and the second pair of the legs 41' and 41" being arranged to clamp another connection bar 10' at a second position B with a distance from the first position so as to retain the clamping force and establish a stable mechanical and electrical connection. It is understood that the clamping devices are made of conductive and flexible material for conducting electricity to the coil and being able to retain a clamping force on the connection bars 10, 10' of the input terminals 14, 14' of the coil as well.

It shall be understood that a fastening device may be designed in other forms and constructions to achieve the same purpose as the above exemplified embodiments.

A guiding member in the form of grooves 17, 17' is provided on the casing 30 to be incorporated with a respective guiding member 27, 27' provided on the inner side of the sidewall 25, 25' and protruding inwardly.

When mounting the first casing part to the frame, the guiding members 17, 17', 27, 27' direct the mounting of the module so that the clamping devices of the output terminals catch hold of the connection bars of the input terminals of the coil, which facilitates the mounting of the module.

Figure 6C:
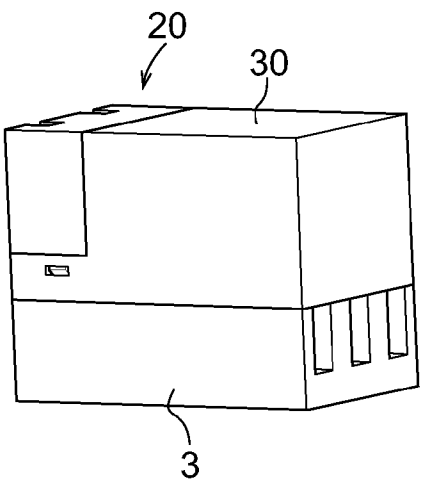
FIG. 6A-6C illustrate mounting steps according to an embodiment of the invention.
Figure 6B:
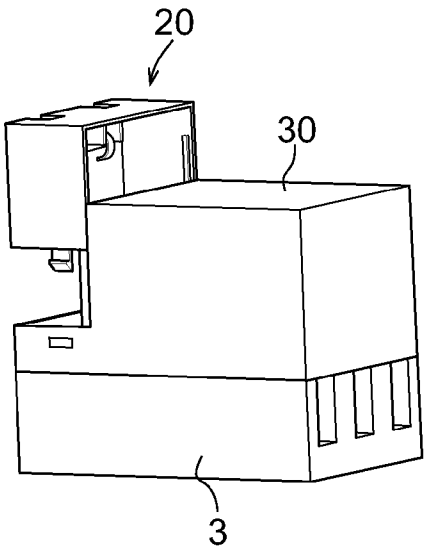
Figure 6A:
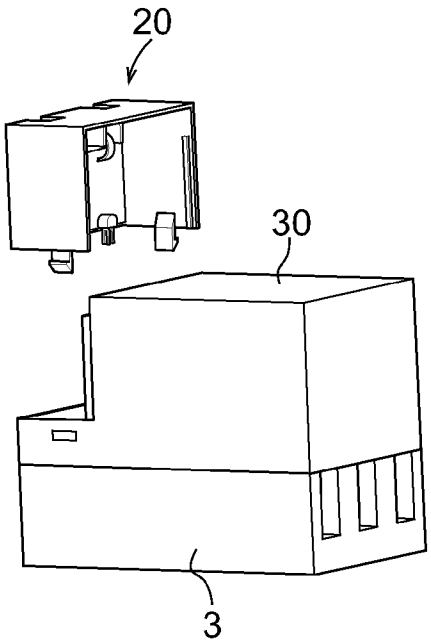

FIGS. 6*a* to FIG. 6*c* illustrate how the module 20 is mounted to the frame according to the embodiment of the invention shown in FIGS. 2-4.

As shown in FIG. 6*a*, other parts of a contactor are mounted prior to the mounting of the module. To mount the module, the guiding member 27, 27' of the module is inserted in the guiding member 17, 17' of the frame. The module is thereafter directed by the guiding members and moves downward to the connection bars of the coil. At a point of the downward movement of the module as shown in FIG. 6*b*, clamping devices reach connection bars and thereon the connection bars are clamped by the legs of the clamping devices, and in the meantime the fastening member 28, 28' of the module reaches on a level with the openings 12, 12' of the frame, thus achieving a snap-fit joint between the module and the frame.

Figure 7C:
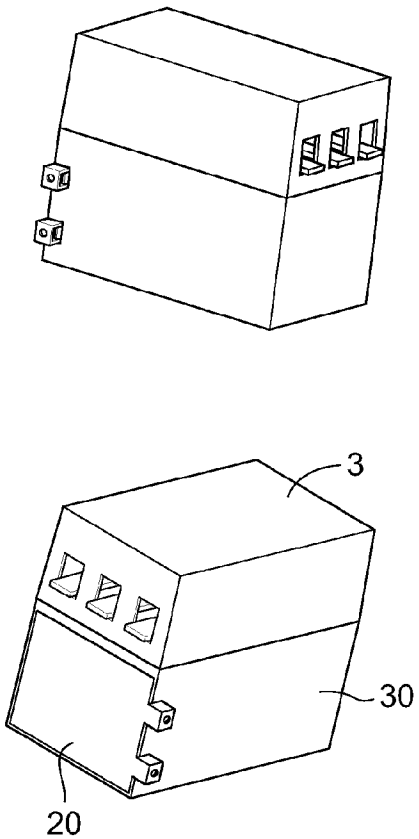
FIG. 7A-7C illustrate mounting steps according to another embodiment of the invention.
Figure 7B:
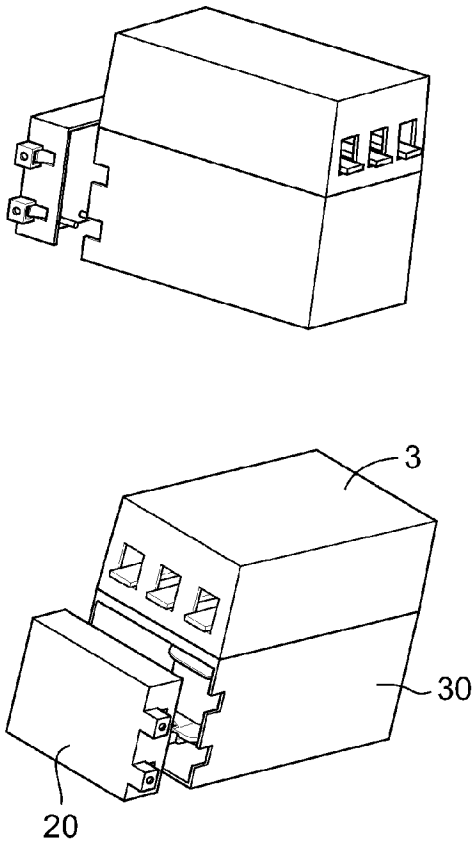
Figure 7A:
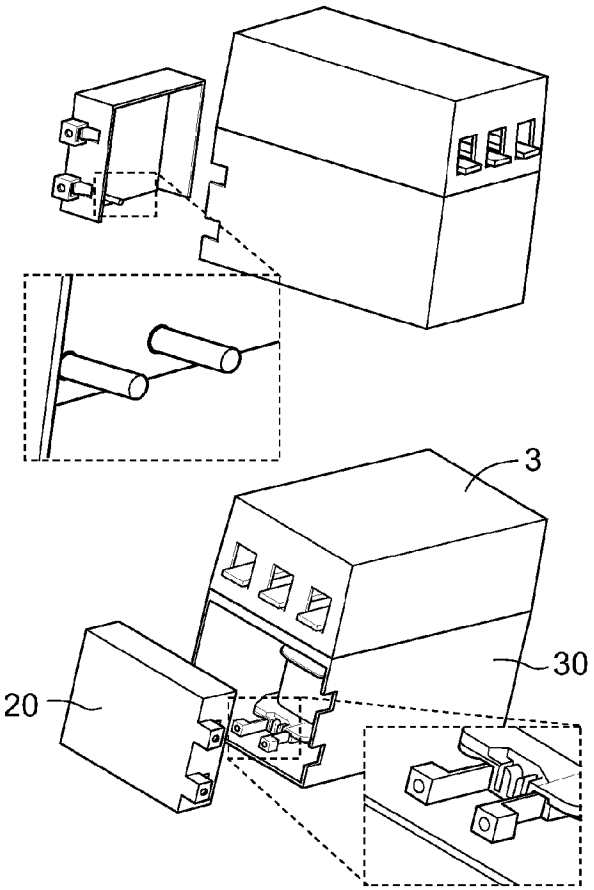

FIGS. 7*a-c* illustrate mounting steps according to another embodiment of the invention. In this example, it is noted that the module is mounted from side. At a point of the movement module as shown in FIG. 7*b*, male connectors reach female connectors arranged on one side of the input terminals of the coil and thereon the female connectors get hold of the male connectors, and in the meantime the fastening member 28, 28' of the module reaches on a level with the openings 12, 12' of the frame, thus achieving a snap-fit joint between the module and the frame.

It is understood that, upon completion of the mounting of the module to the frame shown in FIGS. 6*c* and 7*c*, not only a mechanical connection between the output terminals of the module and the input terminals of the coil is achieved but also an electrical connection, according to the invention. This results in a less cost-consuming assembling process of a contactor.

Figure 11:
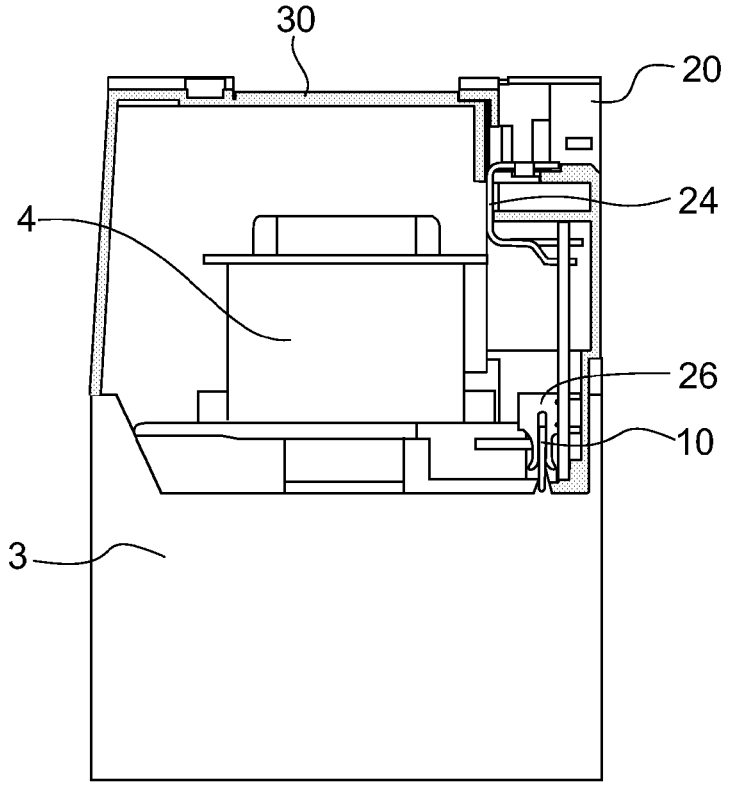
FIG. 11 shows a cross-sectional view of the contactor when it is completely assembled, according to an embodiment of the invention.

A cross-sectional view of the completely assembled contactor is given in FIG. 11, according to one embodiment of the invention.

FIGS. 8*a-b*, 9*a-b* and 10*a-b*, show respectively three other embodiments of the module with a perspective and a corresponding side view.

Figure 10A:
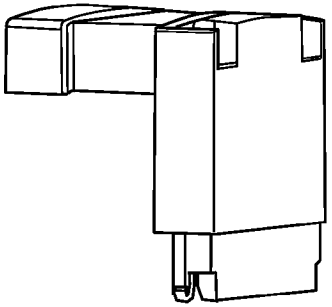
FIG. 10A-10B show a fourth embodiment of the module, according to yet another embodiment of the invention.
Figure 10B:
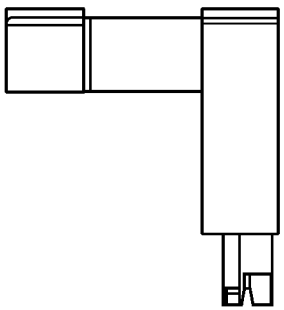
Figure 9A:
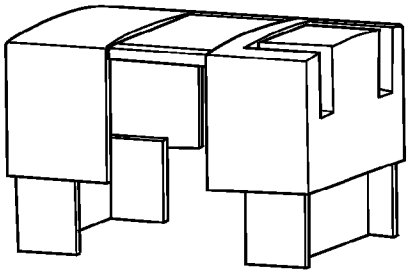
FIG. 9A-9B show a third embodiment of the module, according to another embodiment of the invention.
Figure 9B:
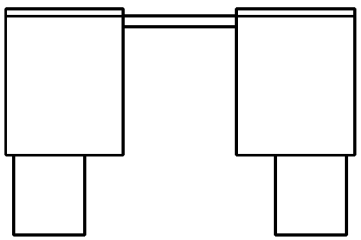
Figure 8A:
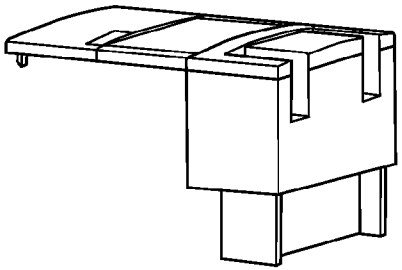
FIG. 8A-8B show a second embodiment of the module, according to an embodiment of the invention.
Figure 8B:
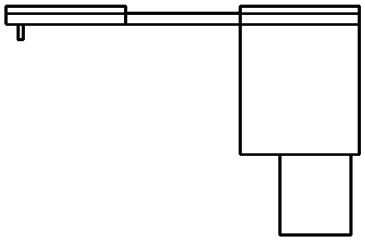

In FIG. 8-*b*, the top wall of the module is extended to cover the most part of the coil. In FIGS. 9*a-b*, two sections are provided on each side of the module and the sections are connected by a bridge. One of the sections includes the electric circuit board. In this embodiment, the module may be arranged to be connected to the base unit. In FIGS. 10*a-b* the module is extended with another section that may include another electric circuit board, for example.

It is, however, possible to have other forms such that the module is detachable from the frame and easy to be connected to the frame.

What is claimed is:

1. A contactor comprising:

a frame including a base unit and a casing for connection to the base unit, the casing including a first casing part and a second casing part;

the first and second casing parts including guiding members, the guiding members being provided on the two sidewalls or on opposite walls, the guiding members being provided on the inner side of the first and second casing part and protruding inwardly;

a coil provided on the base unit and including input terminals;

a module comprising a circuit board for electrically controlling the coil, the circuit board including input terminals for power supply and output terminals for providing an electrical connection to the coil, the module including the second casing part, the second casing part being arranged partly surrounding the circuit board, and the first and second casing parts being arranged to be connected to each other upon connection of the module to the frame such that the casing encloses the circuit board together with the base unit; and a fastening device arranged for mechanically and electrically connecting one of output terminals to a corresponding input terminal of the coil, the fastening device connecting the output terminal of the circuit board to the input terminal of the coil simultaneously with the module being connected to the frame.

2. The contactor of claim 1, wherein the fastening device comprises a male and a female connector, the female connector designed to get hold of the male connector for retaining a contact force between the input terminal of the coil and output terminal of the circuit board when the module is connected to the frame.

3. The contactor of claim 1, wherein the fastening device includes a clamping device and a connection bar, the clamping device is able to clamp the connection bar to retain a contact force between the input terminal of the coil and output terminal of the circuit board.

4. The contactor of claim 3, wherein the clamping device includes a first pair of deformable elements arranged to clamp the connection bar at a first position.

5. The contactor of claim 4, wherein the clamping device includes a second pair of deformable elements, the second pair of deformable elements being arranged to clamp the connection bar at a second position at a distance from the first position.

6. The contactor of claim 1, wherein the module is arranged to be detachable from the frame.

7. The contactor of claim 1, wherein the module further comprises a fastening member for mechanically connecting the module to the frame.

8. The contactor of claim 1, wherein the frame includes a shield for the coil, the module including at least a part of the casing, and said part of the casing being arranged partly surrounding the circuit board.

9. The contactor of claim 1, wherein the first and second casing parts includes a respective guiding member for guiding the module such that the clamping device is connected to the input terminal of the coil upon the connection of the module to the frame.

10. The contactor of claim 1, wherein the circuit board is any of a single electrical circuit board or a print circuit board.

11. A method for assembling a contactor, the contactor comprising:

a frame including a base unit and a casing for connection to the base unit, the casing including a first casing part and a second casing part;

a coil provided on the base unit and including input terminals;

a module having a circuit board for electrically controlling the coil, the circuit board including input terminals for power supply and output terminals for providing an electrical connection to the coil, the module including the second casing part, the second casing part being arranged partly surrounding the circuit board, and the first and second casing parts being arranged to be connected to each other upon connection of the module to the frame such that the casing encloses the circuit board together with the base unit; and; and a fastening device arranged for mechanically and electrically connecting one of output terminals to a corresponding input terminal of the coil, the fastening device connecting the output terminal of the circuit board to the input terminal of the coil simultaneously with the module being connected to the frame;

the method comprising the steps of:

installing the coil on the base unit;

mounting the module to the frame including connecting the module to the frame while at the same time the fastening device connects the output terminals of the circuit board to the corresponding input terminals of the coil; and connecting the first casing part to the second casing part by guiding members provided on the two sidewalls or on opposite walls, the guiding members arranged on the inner side of the first and second parts and protruding inwardly, such that upon mounting the module to the frame such that the circuit board is enclosed by the casing together with the base unit and the assembling is completed.

* * * * *